US006421829B2

(12) United States Patent
Halstead et al.

(10) Patent No.: US 6,421,829 B2
(45) Date of Patent: Jul. 23, 2002

(54) TITANIUM WIRE FACE GUARD

(75) Inventors: P. David Halstead, Knoxville; Garry W. McNabb, Cookeville; David E. Wright, Livingston, all of TN (US)

(73) Assignee: Mad Partners, Cookeville, TN (US)

( * ) Notice: Subject to any disclaimer, the term of this patent is extended or adjusted under 35 U.S.C. 154(b) by 0 days.

(21) Appl. No.: 09/911,749

(22) Filed: Jul. 23, 2001

Related U.S. Application Data

(63) Continuation of application No. 09/514,624, filed on Feb. 28, 2000.

(51) Int. Cl.[7] ..... A42B 3/20
(52) U.S. Cl. ..... 2/9
(58) Field of Search ..... 2/9, 424, 425

(56) References Cited

U.S. PATENT DOCUMENTS

| | | | | |
|---|---|---|---|---|
| 1,775,009 | A | | 9/1930 | Weber |
| 2,105,607 | A | | 1/1938 | McMillan |
| 25,176 | A | | 5/1962 | Novak |
| 4,933,993 | A | | 6/1990 | McClelland |
| 5,249,347 | A | * | 10/1993 | Martinitz |
| 5,411,224 | A | | 5/1995 | Dearman et al. |
| 5,661,849 | A | * | 9/1997 | Hicks |
| 5,713,082 | A | * | 2/1998 | Bassette et al. |
| 5,806,088 | A | * | 9/1998 | Zide et al. |

OTHER PUBLICATIONS

Titanum Industries, Inc. Data Reference Manual Mar. 1998.

* cited by examiner

*Primary Examiner*—Rodney M. Lindsey
(74) *Attorney, Agent, or Firm*—Leudeka, Neely & Graham PC

(57) ABSTRACT

A method of making a face mask including the steps of providing a plurality of lengths of Grade 2, commercially pure titanium wire, having a diameter of from about 0.21 to about 0.24 inches; forming each length at room temperature to a desired bend angle by bending the member at room temperature using rotary bending apparatus to a first bend angle that is from about 1.25 to about 1.35 times greater than the desired bend angle; and welding each of the thus formed lengths to at least one other of the lengths in an ambient, oxygen containing environment.

1 Claim, 8 Drawing Sheets

FIG. 4a
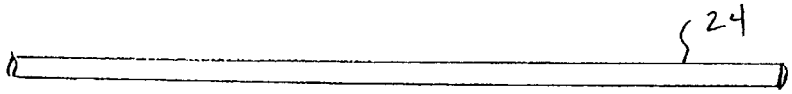
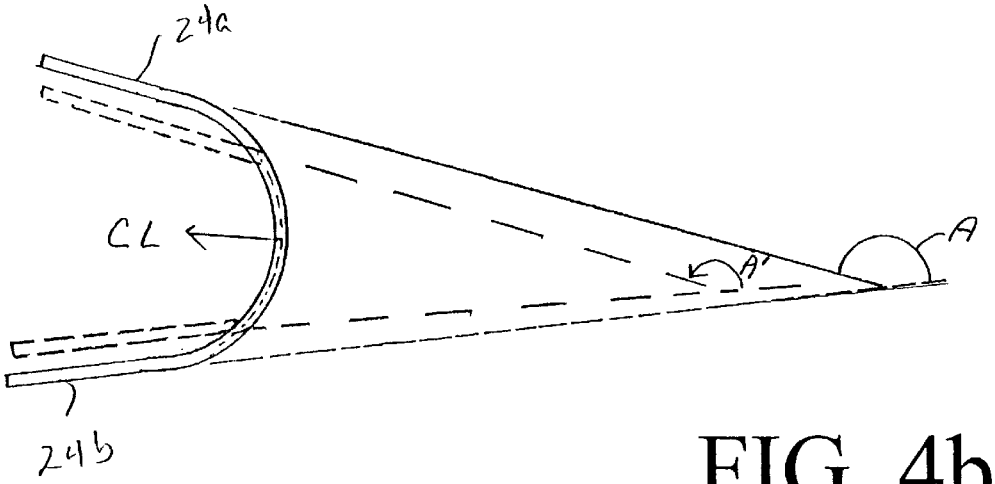
FIG. 4b
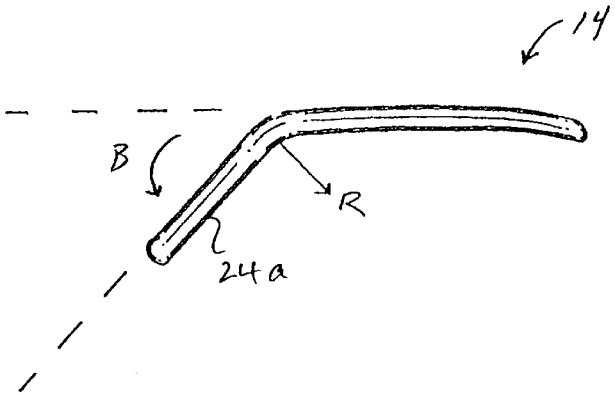
FIG. 4c
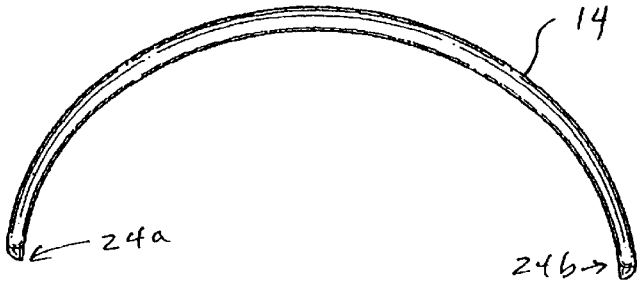
FIG. 4d

FIG. 5a
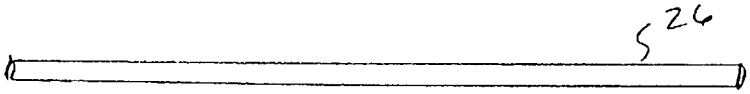
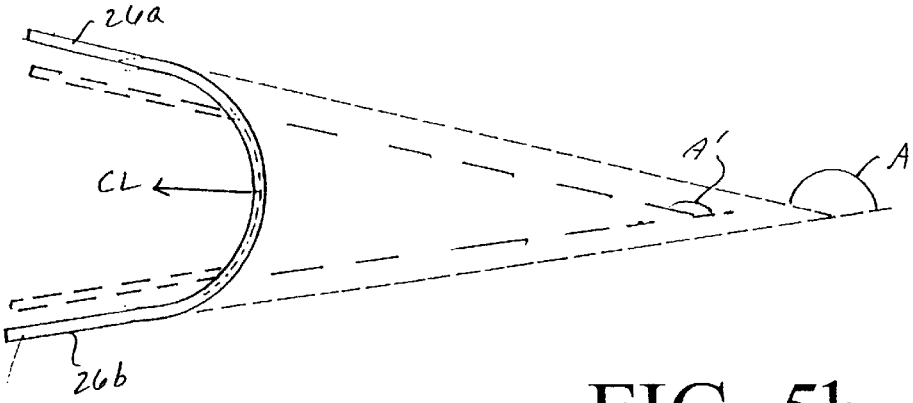
FIG. 5b
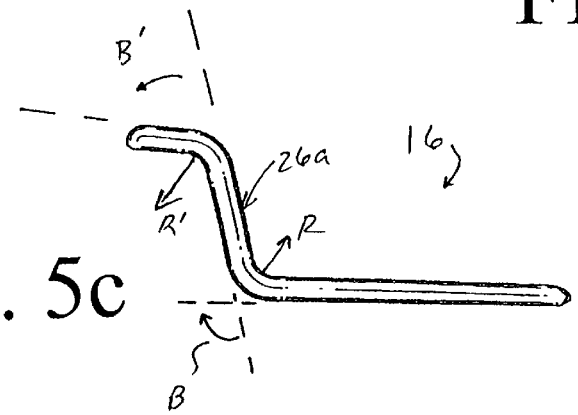
FIG. 5c
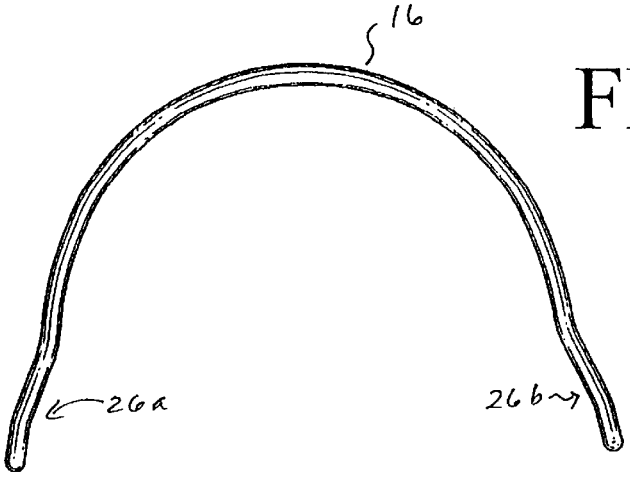
FIG. 5d

FIG. 6a
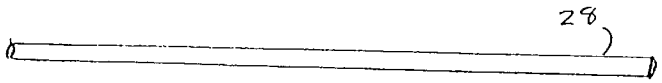
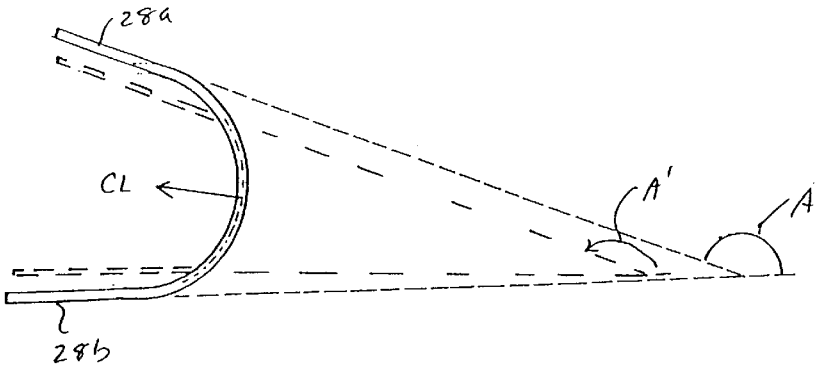
FIG. 6b
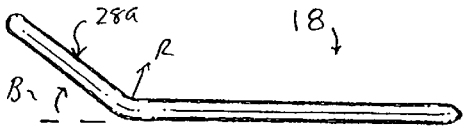
FIG. 6c
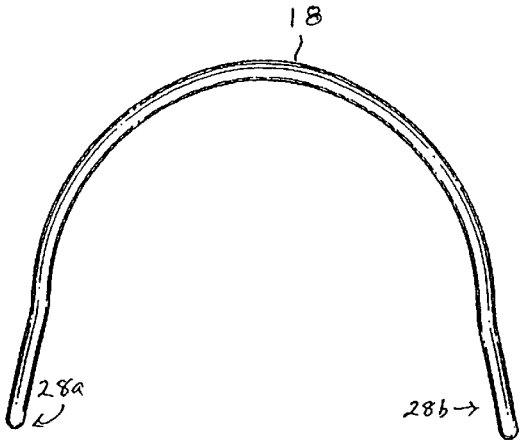
FIG. 6d

FIG. 7a
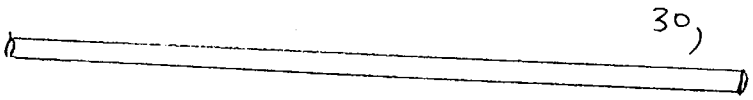
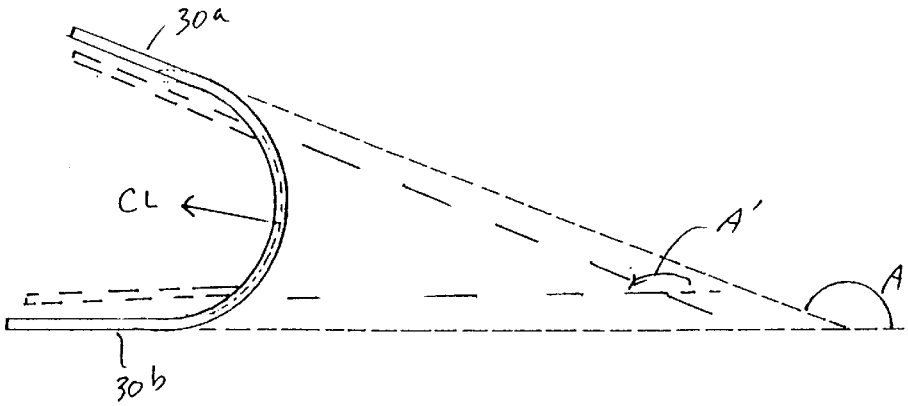
FIG. 7b
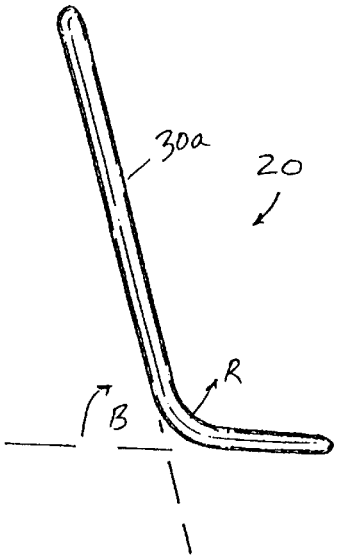
FIG. 7c
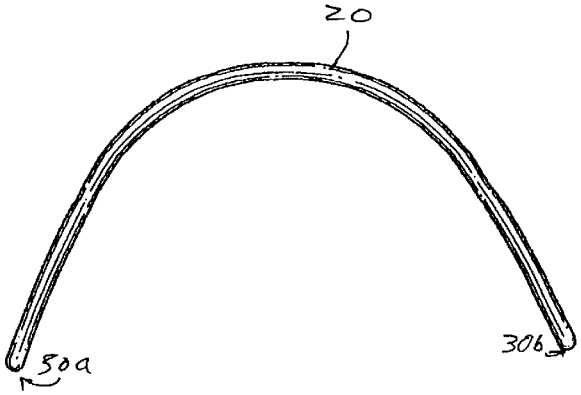
FIG. 7d

FIG. 8a
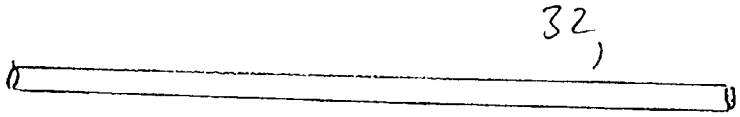
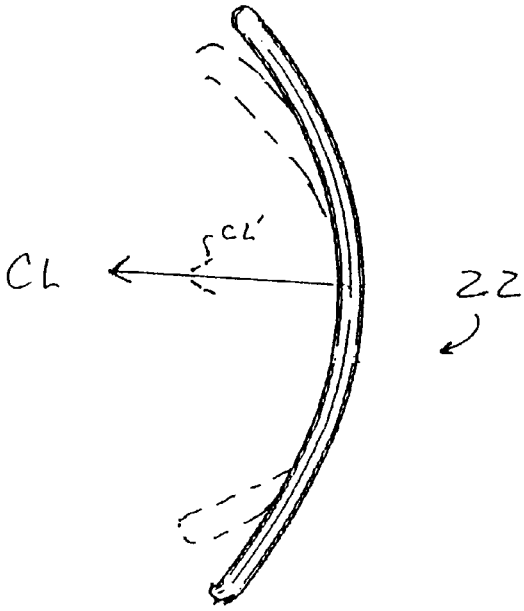
FIG. 8b

TITANIUM WIRE FACE GUARD

CROSS-REFERENCE TO RELATED APPLICATION

This application is a continuation of co-pending application Ser. No. 09/514,624, filed Feb. 28, 2000, and entitled TITANIUM WIRE FACE GUARD AND METHOD FOR MAKING SAME.

FIELD OF THE INVENTION

This invention relates generally to face guards for sporting helmets. More particularly, this invention relates to a face guard for football helmets manufactured using titanium wire and to a method for manufacturing such face guards.

BACKGROUND AND SUMMARY OF THE INVENTION

Conventional face guards or masks for protective helmets, such as football helmets, are typically manufactured using steel wire or steel tubing. Steel-based face guards desire improvement as they are relatively heavy and prone to corrosion.

The invention advantageously relates to a face guard made of titanium wire having advantageous weight and corrosion-resistance characteristics as compared to steel-based face guards. The invention further relates to a method for producing face guards made of titanium wire in an manner that is uncomplicated and cost effective.

Accordingly it is an object of the present invention to provide an improved face guard for protective helmets.

Still another object of the present invention is to provide a face guard of the character described for use with football helmets.

Yet another object of the invention is to provide a face guard of the character described that weighs less than conventional steel-based face guards.

A further object of the invention is to provide a face guard of the character described that is less prone to corrosion as compared to conventional steel-based face guards.

Another object of the invention is to provide a face guard of the character described that is made using titanium wire.

A still further object of the invention is to provide a face guard of the character described that is economical.

Another object of the invention is to provide a method for producing face guards of the character described.

With regard to the foregoing and other objects, the present invention is directed to a method of making a face mask including the steps of providing a plurality of lengths of Grade 2, commercially pure titanium wire, having a diameter of from about 0.21 to about 0.24 inches; forming each length at room temperature using rotary bending apparatus to a desired bend angle by bending the member at room temperature to a first bend angle that is from about 1.25 to about 1.35 times greater than the desired bend angle; and welding each of the thus formed lengths to at least one other of the lengths in an ambient, oxygen containing environment.

In another aspect, the invention relates to a face mask including a plurality of wire members interconnected to one another. Each wire member includes a length of Grade 2, commercially pure titanium wire, having a diameter of from about 0.21 to about 0.24 inches. Each wire member is formed at room temperature using rotary bending apparatus to a desired bend angle by bending the member at room temperature to a first bend angle that is from about 1.25 to about 1.35 times greater than the desired bend angle. Each of the formed members is welded to at least one other of the members in an ambient, oxygen containing environment.

The invention advantageously enables manufacture of titanium face masks in a cost-effective and uncomplicated manner. Face masks in accordance with the invention are lighter in weight than conventional steel-based face masks and offer numerous advantages to conventional face masks.

BRIEF DESCRIPTION OF THE DRAWINGS

Further advantages of the invention will become apparent by reference to the detailed description of preferred embodiments when considered in conjunction with the figures, which are not to scale, wherein like reference numbers, indicate like elements through the several views, and wherein;

FIGS. 4*a–c* show steps in the manufacture of a component of the face guard of FIGS. 1*a–*1*b* and FIG. 4*d* is a top plan view of the finished component;

FIGS. 5*a–*5*c* show steps in the manufacture of another component of the face guard of FIGS. 1*a–*1*b* and FIG. 5*d* is a top plan view of the finished component;

FIGS. 6*a–*6*c* show steps in the manufacture of another component of the face guard of FIGS. 1*a–*1*b* and FIG. 6*d* is a top plan view of the finished component;

FIGS. 7*a–*7*c* show steps in the manufacture of another component of the face guard of FIGS. 1*a–*1*b* and FIG. 7*d* is a top plan view of the finished component;

FIGS. 8*a* and 8*b* show steps in the manufacture of another component of the face guard of FIGS. 1*a–*1*b*, with FIG. 8*b* being a side plan view of the finished component.

DETAILED DESCRIPTION

Figure 1A:
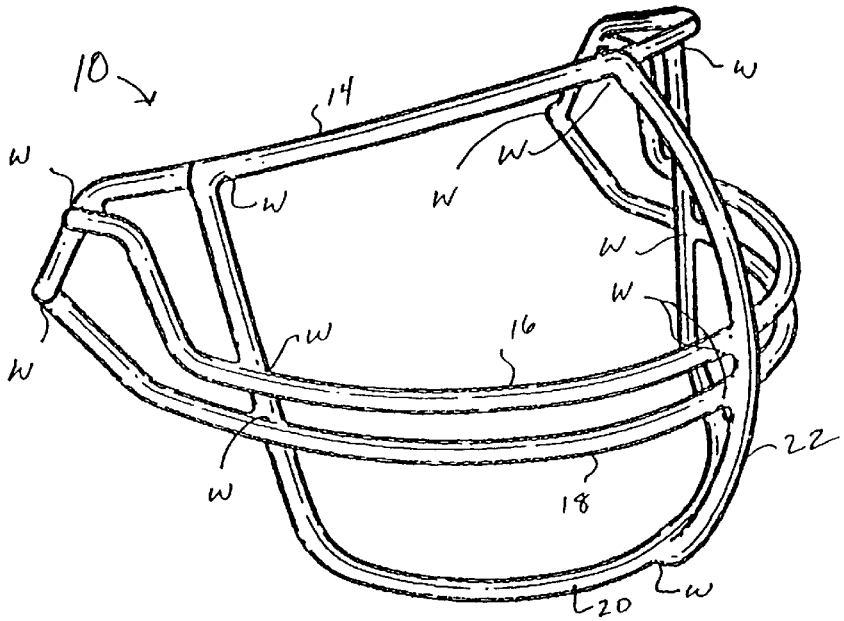
FIGS. 1*a* and 1*b* are front and rear perspective views, respectively, of a face guard in accordance with a preferred embodiment of the invention.
Figure 1B:
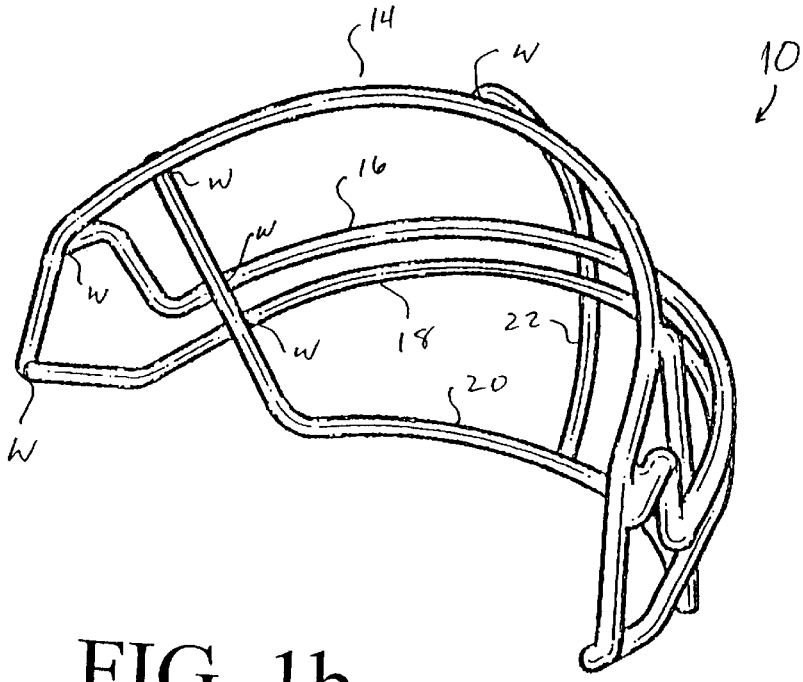
Figure 2:
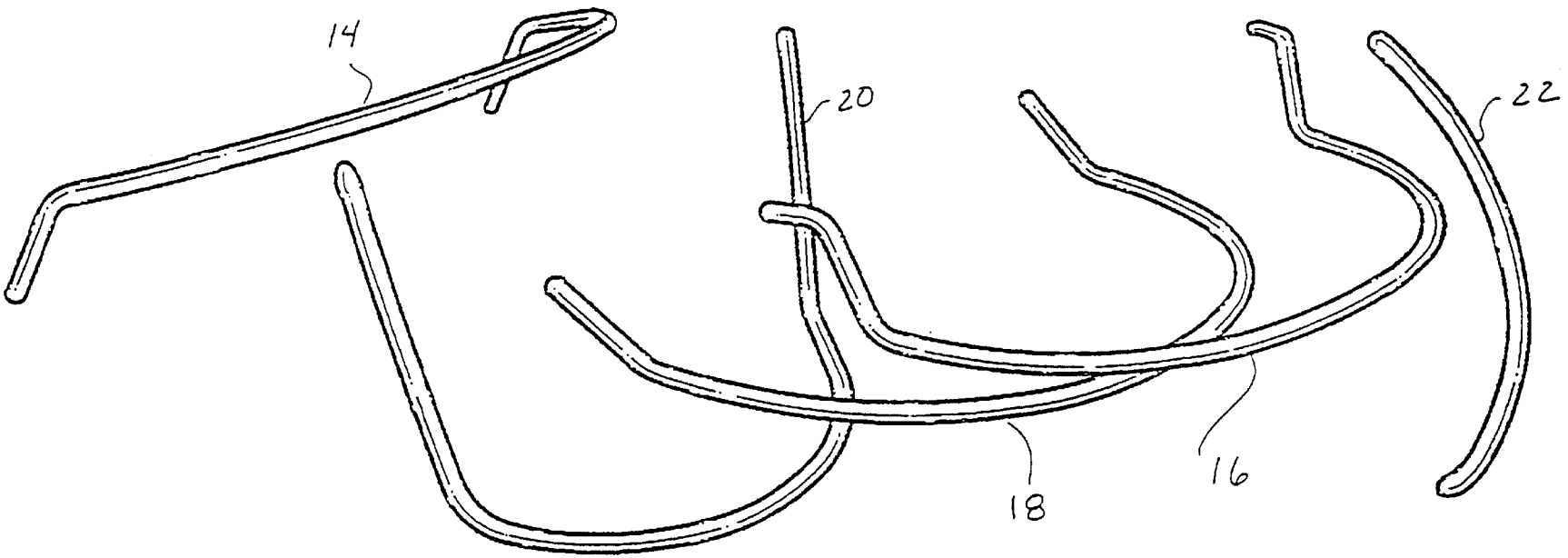
FIG. 2 is an exploded perspective view of the face guard of FIGS. 1*a* and 1*b;*
Figure 3:
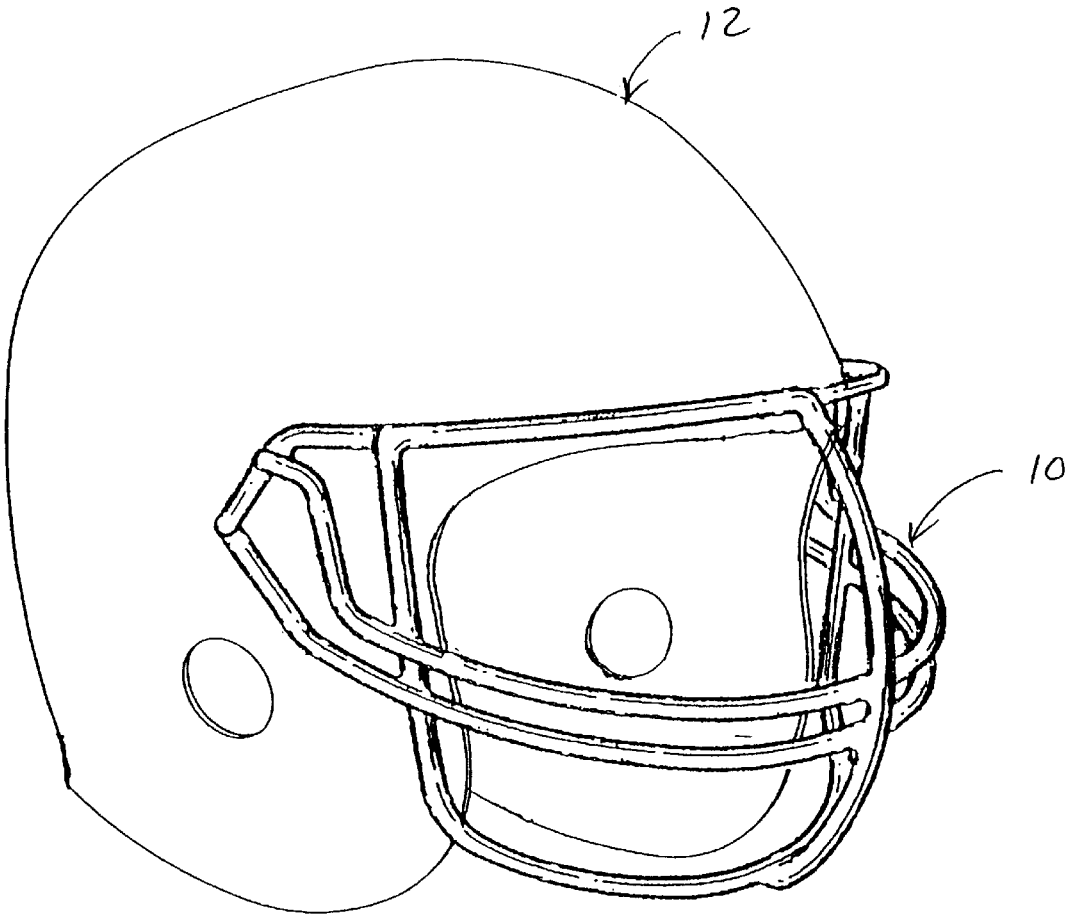
FIG. 3 is a front perspective view of a football helmet having the face guard of FIGS. 1*a–b* installed thereon.

With reference to the drawing figures, the invention relates to a face guard or mask 10 that is particularly suitable for use with a sporting helmet, such as a football helmet 12 (FIG. 3). The mask 10 includes a plurality of interconnected members such as members 14, 16, 18, 20 and 22 interconnected by welds W, as discussed in more detail below.

Each of the members 14–22 is preferably provided by a length of Grade 2, commercially pure titanium wire, having a diameter of about 0.224 inches. FIGS. 4*a*, 5*a*, 6*a*, 7*a* and 8*a* show wires 24, 26, 28, 30 and 32 which are formed into the members 14–22, respectively, and welded to provide the welds W in accordance with the method of the invention. The formed face mask is thereafter preferably coated with a bonded vinyl powder coating to a thickness of from about 0.02 to about 0.09 inches and attached to the helmet 12 using conventional mounting components and techniques.

In the manufacture of the members 14–22, lengths of wire material are provided by shearing as set forth in TABLE 1:

TABLE 1

| Wire | Shear length (inches) |
|---|---|
| 24 | 16.25 |
| 26 | 17.75 |
| 28 | 18.06 |
| 30 | 18.25 |
| 32 | 7.50 |

It will be understood that the foregoing lengths are for a preferred embodiment only and that the wires may be of various other lengths depending on the desired configuration and size of the mask.

The members are next formed, preferably at room temperature (e.g., about 50 to about 80° F.), to impart a desired shape to each of the wires 24–32, the desired configuration preferably being that shown for the members 14–22, respectively.

In this regard, and with reference to FIGS. 4*b*–4*d*, the wire 24 is preferably formed into member 14 by first bending the wire 24 into the configuration of FIG. 4*b* as by rotary bending using a die of desired dimension to achieve a desired formed degree of bend, represented by the angle A, of about 159 degrees and a center-line radius (CL) of about 4.34 inches. The formed wire 24 is substantially symmetrical and bilateral, as shown in the top plan view of FIG. 4*d*.

As will be noted, ends 24*a* and 24*b* of the wire 24 are substantially outside of the bend imparted as shown in FIG. 4*b*. The ends 24*a* and 24*b* are preferably about 2 inches in length and are formed as explained below using press brake bending equipment to achieve the final configuration of the member 24.

Returning to the initial manipulation of the wire 24 to achieve the desired formed degree of bend, it has been experienced that a formed degree of bend of 159 degrees for the member 14 may be achieved using a die having a radius of about 3.195 inches and overbending the wire 24 to a degree of bend A', shown in phantom, of about 206 degrees. Thus, the wire 24 must be significantly bent past the desired formed degree of bend to impart the desired bend. The foregoing described bend and the similar bends described below in connection with FIGS. 5*b*, 6*b*, 7*b* and 8*b* are preferably made using rotary bending apparatus and at room temperature. Preferred apparatus is a rotary bending machine available from Lubow, under Model No. ML-1025

Next, additional bends are preferably imparted to the ends 24*a* and 24*b* in a similar manner of overbending. To provide the preferred configuration for the member 24, the ends 24*a* and 24*b* are each preferably bent to achieve a formed degree of bend of about 46 degrees, represented by the angle B, with an inside bend radius (R) of about 0.75 inches. To achieve this, the ends 24*a* and 24*b* are subjected to overbending of about 53 degrees (FIG. 4C). These bends and the similar bends of FIGS. 5*c*, 6*c* and 7*c* are preferably made using a press brake bending machine. A preferred press brake bending machine is available from Niagra, of Buffalo, N.Y., under Model No. M IB-15-5-6

The members 16–22 are formed from the wires 26–32 in a similar manner. For example, with reference to FIGS. 5*a*–5*d*, the wire 26 is preferably formed into the member 16 by first bending the wire 26 into the configuration of FIG. 5*b* as by rotary bending using a die of desired dimension to achieve a desired formed degree of bend, represented by the angle A, of about 164 degrees and a center-line radius (CL) of about 3.85 inches. The formed wire 26 is substantially symmetrical and bilateral, as shown in the top plan view of FIG. 5*d*.

It has been experienced that a formed degree of bend of 164 degrees for the member 16 may be achieved using a die having a radius of about 2.977 inches and overbending the wire 26 to a degree of bend A', shown in phantom, of about 214 degrees.

Ends 26*a* and 26*b* (FIG. 5*b*) each preferably have a length of about 2.125 inches. A first portion of each end 26*a*, 26*b* having a length of about 0.875 inches is preferably bent to achieve a formed degree of bend of about 74 degrees, represented by the angle B, with an inside bend radius (R) of about 0.25 inches. To achieve this, the first portion is subjected to overbending of about 79 degrees (FIG. 5C).

A second portion of the ends 26*a* and 26*b* having a length of about 1.25 inches is similarly formed to achieve a formed degree of bend of about 74 degrees, represented by the angle B', with an inside bend radius (R') of about 0.25 inches. To achieve this, the first portion is subjected to overbending of about 79 degrees (FIG. 5C).

As shown in FIGS. 6*a*–6*d*, the wire 28 is preferably formed into the member 18 by first bending the wire 28 into the configuration of FIG. 6*b* as by rotary bending using a die of desired dimension to achieve a desired formed degree of bend, represented by the angle A, of about 164 degrees and a center-line radius (CL) of about 3.81 inches. The formed wire 28 is substantially symmetrical and bilateral, as shown in the top plan view of FIG. 6*d*.

It has been experienced that a formed degree of bend of 164 degrees for the member 18 may be achieved using a die having a radius of about 2.977 inches and overbending the wire 28 to a degree of bend A', shown in phantom, of about 213 degrees.

Ends 28*a* and 28*b* (FIG. 6*b*) each preferably have a length of about 1.9 inches and are bent to achieve a formed degree of bend of about 33 degrees, represented by the angle B, with an inside bend radius (R) of about 0.25 inches. To achieve this, the first portion is subjected to overbending of about 38 degrees (FIG. 6C).

As shown in FIGS. 7*a*–7*d*, the wire 30 is preferably formed into the member 20 by first bending the wire 30 into the configuration of FIG. 7*b* as by rotary bending using a die of desired dimension to achieve a desired formed degree of bend, represented by the angle A, of about 157 degrees and a center-line radius (CL) of about 3.55 inches. The formed wire 30 is substantially symmetrical and bilateral, as shown in the top plan view of FIG. 7*d*.

It has been experienced that a formed degree of bend of 164 degrees for the member 20 may be achieved using a die having a radius of about 2.857 inches and overbending the wire 28 to a degree of bend A', shown in phantom, of about 200 degrees.

Ends 30*a* and 30*b* (FIG. 7*b*) each preferably have a length of about 4.9 inches and are bent to achieve a formed degree of bend of about 67 degrees, represented by the angle B, with an inside bend radius (R) of about 0.75 degrees. To achieve this, the first portion is subjected to overbending of about 72 degrees (FIG. 7C).

Wire 32 (FIG. 8*a*) is preferably formed into the member 22 by bending the wire 32 into the configuration of FIG. 8*b* as by rotary bending using a die having a radius of about 3.195 inches to achieve a continuous bend, as shown in FIG. 8*b*, with a center-line radius (CL) of about 4.81 inches. To achieve this, the bend applied is approximately 1.29 times that of the final bend, such that the wire 32 is bend to have a center-line radius (CL') (shown in phantom) of about 2.476 inches so that when the bending force is removed, the set or formed bend has a radius of about 3.195 inches.

The foregoing information concerning the formation of the members 14–22 from the wires 24–32 is provided below in Tables 2 and 3. Table 2 relates to the primary bends in the members (FIGS. 4*b*, 5*b*, 6*b*, 7*b* and 8*b*) and Table 3 relates to the subsequent bends (FIGS. 4*c*, 5*c*, 6*c* and 7*c*).

TABLE 2

| Member | Die Radius (in) | (A') Degree of Bend Applied | (A) Formed Degree of Bend | Center Line (CL) Radius (in) |
|---|---|---|---|---|
| 14 | 3.195 | 206 | 159 | 4.34 |
| 16 | 2.977 | 214 | 164 | 3.85 |
| 18 | 2.977 | 213 | 164 | 3.81 |
| 20 | 2.857 | 200 | 157 | 3.55 |
| 22 | 3.195 | continuous | continuous | 4.81 |

As will be noted from Table 2, for bends formed using the described rotary bending apparatus, the ratio of the degree of bend applied to that of the formed bend is generally between about 1.25 and 1.35 and, is most preferably between about 1.28 and 1.30.

TABLE 3

| Member | Degree of Bend Applied | (B) Formed Degree of Bend | Inside Bend Radius (in) |
|---|---|---|---|
| 14 | 46 | 41 | 0.75 |
| 16 | 79 | 74 | 0.25 |
| | 79 | 74 (B') | 0.25 |
| 18 | 38 | 33 | 0.25 |
| 20 | 72 | 67 | 0.75 |

As will be noted from Table 3, for bends formed using the described press bending apparatus, the ratio of the degree of bend applied to that of the formed bend is generally between about 1.05 and 1.16 and, is most preferably between about 1.07 and 1.15.

The formed members 14–22 are thereafter arranged in the desired configuration and held in position and squeezed against one another, as by a clamp fixture, for welding. Welding is accomplished as by spot welding at each weld location W using a press-type projection welder of the type available from Standard Resistance Welding Company of Winston, Ga. A preferred welder is A 50 KVA, 460 Volt, single phase welder available from Standard Resistance Welder Company.

The transformer setting or TAP setting for the welder is preferably set at about 7, with the welder control settings set forth in TABLE 4:

TABLE 4

| Welder Control | Preferred Value | Range |
|---|---|---|
| Squeeze | 10 | 1–100 |
| Weld/heat | 24 | 15–28 |
| Percent current | 28 | 23–29 |
| Hold | 01 | ≧01 |

It is surprising that welds of suitable strength to achieve a face mask compliant with the relevant standards of the National Operating Committee on Standards for Athletic Equipment (NOCSAE) such as the NOCSAE Standard Method of Impact and Performance Requirements for Football Faceguards (Jul. 14, 1987 , Revised Jul. 10, 1990) were achievable. It is known that titanium is highly reactive and would not be expected to provide suitable weld strength when welded in a reactive environment, such as in the presence of oxygen. As will be appreciated, the ability to achieve suitable weld strength in this manner achieves considerable cost savings as compared to welding in a non-reactive environment.

For the purposes of the invention, it was observed that the settings set forth in Table 3 were important to achieving suitable weld strength.

After welding, the guard is removed from the fixture and all wire terminations ground using silicon carbide sandpaper to a full radius to avoid sharp ends. The face guard is thereafter cleaned, primed with a bonding agent, such as a lacquer basic phenolic bonding agent, and coated with vinyl to a thickness of from about 0.02 to about 0.09 inches.

When used for football helmets, face guards in accordance with the invention should be tested for compliance with the afore-mentioned NOCSAE standard. Likewise, compliance with any other relevant standards or criteria should be determined dependent upon the intended use of the face guard.

A face guard constructed as described herein was observed to have a weight less than that of conventional steel wire and steel tubing face guards. For example, a similarly configured face guard made from steel wire of the same diameter (0.225 inches) would have a weight of over about 16 ounces, uncoated, and one made from steel tubing having an outside diameter of about 0.25 inches (i.d. 0.160 inches) would have a weight of at least about 11 ounces, uncoated. The foregoing described face guard of the invention has a weight of about 9 ounces, uncoated.

It has also been observed that face guards made in accordance with the invention are more resistant to corrosion than conventional steel and steel tubing face guards.

The invention advances the art by enabling the production of face guards made of titanium wire which have desirable qualities and which may be produced in an economical and uncomplicated manner. It has been stated in the prior art that face guards could be made using titanium containing materials. For example, U.S. Pat. No. 5,713,082 states that the face mask thereof "is usually cast with thin cross sections as a single piece and hardened using high strength alloys (e.g. titanium, 4140 steel, 4140 stainless steel, etc.)." Col. 5, lines 2–4. U.S. Pat. No. 5,806,088 describes a face guard of metal tubes construction, with a metal tube 22 thereof made of steel, or of other metals or metal alloys (metal mixtures) such as aluminum, carbon, cobalt, chromium, iron, nickel, tin titanium and zinc. Co, 4, lines 7–11. It is believed that prior attempts to manufacture face guards using titanium containing materials have resulted in face guards that are unsuitable for their intended purpose and/or of such expense so at to be commercially unfeasible.

It has unexpectedly been discovered that face guards of desirable characteristics may be economically produced in accordance with the invention. For example, in accordance with the invention, it has been discovered that face guards having desirable characteristics may be manufactured using Grade 2, commercially pure titanium wire, having a diameter of from about 0.21 to about 0.24 inches, most preferably from about 0.224 to about 0.225 inches. For the purposes of the invention, it was observed that the selection of this particular material in the afore-mentioned diameter range was important to achieving the purposes of the invention.

The foregoing description of certain exemplary embodiments of the present invention has been provided for purposes of illustration only, and it is understood that numerous modifications or alterations may be made in and to the illustrated embodiments without departing from the spirit and scope of the invention as defined in the following claims.

What is claimed is:

1. A face mask, comprising:

a plurality of wire members, each wire member comprising a length of Grade 2,commercially pure titanium wire and having a diameter of from about 0.21 to about 0.24 inches, positioned in a desired configuration and interconnected to one another by a plurality of welds, each weld being a resistance spot weld formed in the presence of oxygen and having suitable strength such that the face mask complies with the Standard Method of Impact and Performance Requirements of the National Operating Committee on Standards for Athletic Equipment (Jul. 14, 1987, Revised Jul. 10, 1990).

* * * * *